US006305553B1

(12) United States Patent
Tirschler

(10) Patent No.: US 6,305,553 B1
(45) Date of Patent: Oct. 23, 2001

(54) ROLLING SCREEN GAPPING SYSTEM

(76) Inventor: Ehrenfried A. Tirschler, 2034, ch. Bord du Lac, Ile-Bizard (CA), H9C 1A4

( * ) Notice: Subject to any disclaimer, the term of this patent is extended or adjusted under 35 U.S.C. 154(b) by 0 days.

(21) Appl. No.: 09/630,800

(22) Filed: Aug. 2, 2000

Related U.S. Application Data

(60) Provisional application No. 60/147,144, filed on Aug. 4, 1999.

(51) Int. Cl.[7] ..... B07B 13/07

(52) U.S. Cl. ..... 209/668; 209/606; 209/617; 209/618; 209/659; 209/660; 209/667

(58) Field of Search ..... 209/606, 617, 209/618, 659, 660, 667, 668

(56) References Cited

U.S. PATENT DOCUMENTS

| | | | | |
|---|---|---|---|---|
| 3,848,741 | | 11/1974 | Haley et al. . | |
| 4,405,050 | * | 9/1983 | Fenton, Jr. et al. | 209/668 |
| 4,627,541 | * | 12/1986 | Johnson | 209/668 |
| 4,979,624 | | 12/1990 | Ellis . | |
| 5,012,688 | | 5/1991 | Ellis . | |
| 5,060,806 | | 10/1991 | Savage . | |
| 5,513,741 | | 5/1996 | Ellis . | |
| 5,590,793 | | 1/1997 | Johansson . | |
| 5,699,898 | | 12/1997 | Bartlmuss et al. . | |
| 5,740,922 | | 4/1998 | Williams . | |
| 6,053,330 | | 4/2000 | Lavoie . | |

* cited by examiner

*Primary Examiner*—Donald P. Walsh
*Assistant Examiner*—Mark J. Beauchaine

(57) ABSTRACT

The present invention provides a roller screen gapping system for a roller screen including a series of spaced parallel rolls mounted on pillow blocks at each end thereof, the pillow blocks slidable along respective bed plates transversely of the roll axes to adjust the gap between adjacent rolls. The gapping system comprises spring biased bolts to clamp the pillow blocks on the bed plates, unclamping cylinders carried by each pillow block and exerting an unclamping action on the bed plate to unclamp the pillow blocks for lateral sliding, gapping cylinders carried by each pillow block adapted to contact an adjacent pillow block to adjust the gap between adjacent rolls and a common push cylinder mounted on each of the bed plates and adapted to push all the pillow blocks against a fixed pillow block. A hydraulic control circuit including various solenoid valves controls the operation of the different hydraulic cylinders. The invention also provides for the method of operating the gapping system.

16 Claims, 9 Drawing Sheets

ROLLING SCREEN GAPPING SYSTEM

This application claims benefit of Provisional No. 60/147,144 filed Aug. 4, 1999.

FIELD OF THE INVENTION

The present invention relates to roller screens and, more particularly, to a system for adjusting the gap between adjacent rolls of the screen.

BACKGROUND OF THE INVENTION

The screens are used especially in the mining industry for classifying pellets as to size. A series of motor-driven parallel rolls are mounted on a bed frame with specific gaps between the individual rolls. The screen is inclined and can be made of a single roller deck or a double roller deck. The double roller deck is composed of an upper and a lower deck and its function is described below. The pellets are discharged onto the upper deck. All pellets having a larger size than the upper deck roll gap (oversized pellets) are transported to the end of the upper deck. All pellets having a smaller size than the upper deck roll gap are passing through these gaps onto the rolls of the lower deck. All pellets having a larger size than the lower deck roll gap (correct size pellets) are transported to the end of the lower deck. All pellets having a smaller size than the lower deck roll gap (undersized pellets or fines) are passing through these gaps. The roll surface becomes pitted and worn due to abrasion produced by the pellets and, therefore, the roll gap must be adjusted from time to time. The roll gaps may also need to be adjusted upon different pellet sizes required and specified by any specific end customer. This adjustment is conventionally a manual operation requiring bolting and unbolting of the individual rolls pillow blocks and adjustment of the gap by means of wedges or gauges inserted between the rolls at each end of the same. This is a time consuming operation.

OBJECTS OF THE INVENTION

The main object of the present invention is to provide a gapping system which is more convenient to operate and will considerably decrease the time necessary for roll gap adjustment and increase the precision of this adjustment.

Another object of the present invention is to provide a gapping system of the character described which can be remotely controlled and which can be either partially or fully automated.

Still another object of the present invention is to provide a gapping system that allows for adjusting either one, a plurality or all of the gaps between adjacent rolls at a time.

A further object of the present invention is to provide a method for rapidly and accurately adjusting the gaps between adjacent rolls of a roller screen apparatus.

SUMMARY OF THE INVENTION

According to one aspect of the present invention, there is provided a roller screen gapping system for a roller screen including a series of spaced parallel rolls mounted on pillow blocks at each end thereof, said pillow blocks slidable along respective bed plates transversely of the roll axes to adjust the gap between adjacent rolls, said system comprises biasing members to clamp said pillow blocks on said bed plates, unclamping cylinders carried by each pillow block and exerting an unclamping action on said bed plate to unclamp said pillow blocks for lateral sliding, gapping cylinders carried by each pillow block adapted to contact an adjacent pillow block to adjust the gap between adjacent rolls and a common push cylinder mounted on each of said bed plates and adapted to push all the pillow blocks against a fixed pillow block.

Preferably, each one of said pillow blocks supporting an end of a shaft of a respective one of said rolls and including a top section adapted to rotatably support the end of said shaft and a base section rigidly mounted onto said bed plate, said top section being slidably mounted onto said base section and frictionally retained thereon by a shoulder bolt with interposition of a biasing device, said top section being allowed to slightly slide along the axial direction of said shaft, thereby accounting for small axial displacement of said roll and said shaft caused by expansion and contraction of the latter under temperature changes.

Preferably, said biasing device being a belleville washer.

Preferably, said cylinders are hydraulic cylinders connected to a hydraulic control circuit, said biasing members being spring biased bolts.

Alternatively, said gapping cylinders are adapted to maximize the gap between adjacent of said rolls, said system further comprising a plurality of spacer members each of a specific thickness adapted to set the gap between said adjacent rolls.

Preferably, said biasing members being spring biased bolts.

Alternatively, each of said pillow blocks further carries an adjustment member adapted to be displaced to and from said respective pillow block to adjust a relative zero gap between adjacent of said pillow blocks corresponding to a zero gap between respective of said rolls.

Preferably, said biasing members being spring biased bolts and said adjustment member being adjustment screws.

Preferably, each of said adjustment members further include an adjustment lock to releasably lock said respective adjustment screw in position.

According to another aspect of the present invention, there is provided a method for adjusting a gap between respective adjacent rolls of a roller screen apparatus using a roller screen gapping system as defined above, said method comprises the steps of:

a) actuating said unclamping cylinders;

b) actuating said common push cylinders to push all of said pillow blocks against said fixed pillow block to set a zero gap condition of at least one of said rolls to be displaced, while said gapping cylinders of said at least one roll to be displaced being allowed to retract;

c) actuating said gapping cylinders of said at least one roll by a precise amount to obtain a required respective gap between the latter and the respective next of said rolls, while said common cylinders being allowed to partially retract; and d) de-actuating said unclamping cylinders to allow for the clamping of said pillow blocks to respective of said bed plates.

Preferably, steps b) and c) being repeated before step d) for each of said respective gap to be adjusted.

Alternatively, the method comprises the steps of:

a) actuating said unclamping cylinders;

b) actuating said gapping cylinders to push all of said pillow blocks away from adjacent of said pillow blocks to maximize said gap between adjacent of aid rolls, while said common push cylinders being allowed to retract;

c) placing said spacer members between respective said adjacent rolls;

d) actuating said common push cylinders to displace all of said pillow blocks toward said fixed pillow block to ensure each of said spacer members being touched by two adjacent of said rolls, while said gapping cylinders being allowed to retract;

e) de-actuating said unclamping cylinders to allow for the clamping of said pillow blocks to respective of said bed plates; and f) removing all of said spacer members.

Preferably, the method further comprises, after steps b) and c) the step of, respectively:

b') de-actuating said unclamping cylinders to allow for the clamping of said pillow blocks to respective of said bed plates; and c') actuating said unclamping cylinders.

Alternatively, the method comprises the steps of:

a) actuating said unclamping cylinders;

b) actuating said gapping cylinders to push all of said pillow blocks away from adjacent of said pillow blocks to maximize said gap between adjacent of said rolls, while said common push cylinders being allowed to retract;

c) placing said spacer members between respective said adjacent pillow blocks next to said respective adjustment member;

d) actuating said common push cylinders to displace all of said pillow blocks toward said fixed pillow block to ensure each of said spacer members being touched by two adjacent of said pillow blocks, while said gapping cylinders being allowed to retract; and e) de-actuating said unclamping cylinders to allow for the clamping of said pillow blocks to respective of said bed plates.

Preferably, the method further comprises, before the step a) the steps of:

i) actuating said unclamping cylinders;

ii) actuating said gapping cylinders to push all of said pillow blocks away from adjacent of said pillow blocks to maximize said gap between adjacent of said rolls, while said common push cylinders being allowed to retract;

iii) removing said spacer members if they are in place, and slightly displacing said adjustment members towards respective of said pillow blocks;

iv) actuating said common push cylinders to displace all of said pillow blocks toward said fixed pillow block to ensure each of said rolls touching its adjacent ones and set a zero gap condition between all of said adjacent rolls, while said gapping cylinders being allowed to retract;

v) de-actuating said unclamping cylinders to allow for the clamping of said pillow blocks to respective of said bed plates; and vi) displacing said adjustment members away from respective of said pillow blocks until touching the adjacent of said pillow blocks.

Preferably, the method further comprises, after steps ii), iii), b) and c) the step of, respectively:

ii') de-actuating said unclamping cylinders to allow for the clamping of said pillow blocks to respective of said bed plates;

iii') actuating said unclamping cylinders;

b') de-actuating said unclamping cylinders to allow for the clamping of said pillow blocks to respective of said bed plates; and c') actuating said unclamping cylinders.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
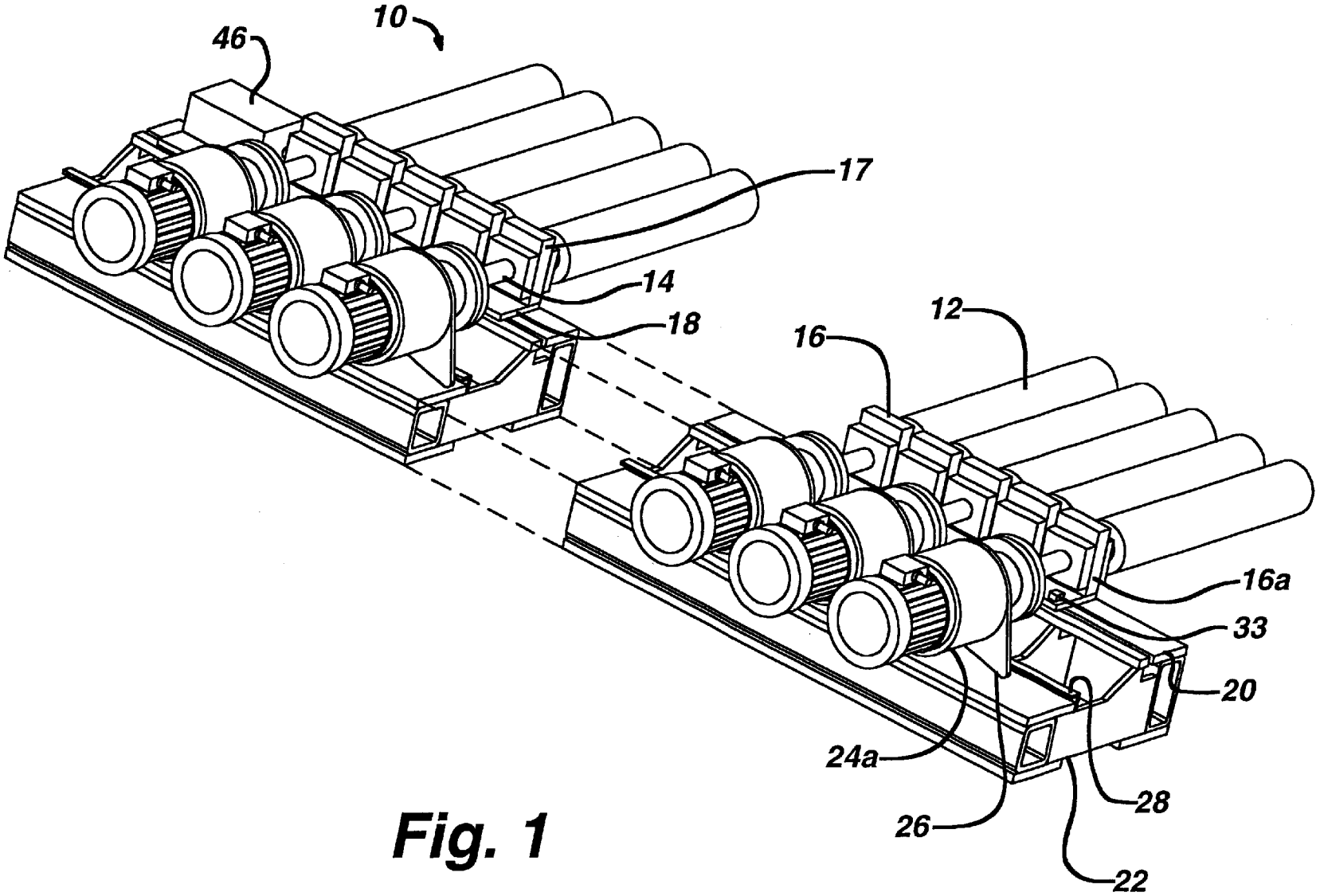
FIG. 1 is a partial perspective view of one side of a roller screen.
Figure 2:
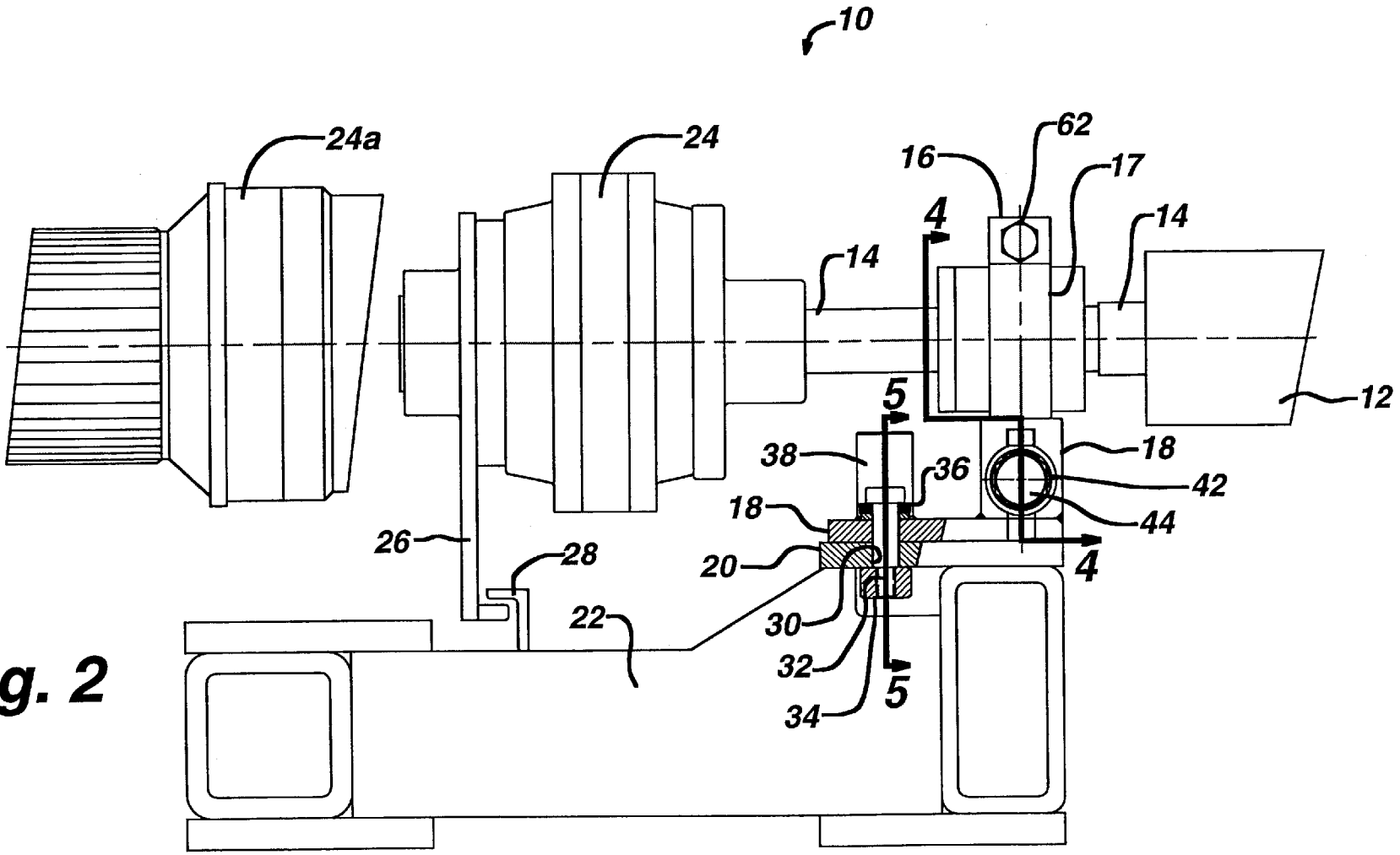
FIG. 2 is a partial elevation view of one roll with driving motor and mounted on a bed plate.
Figure 3:
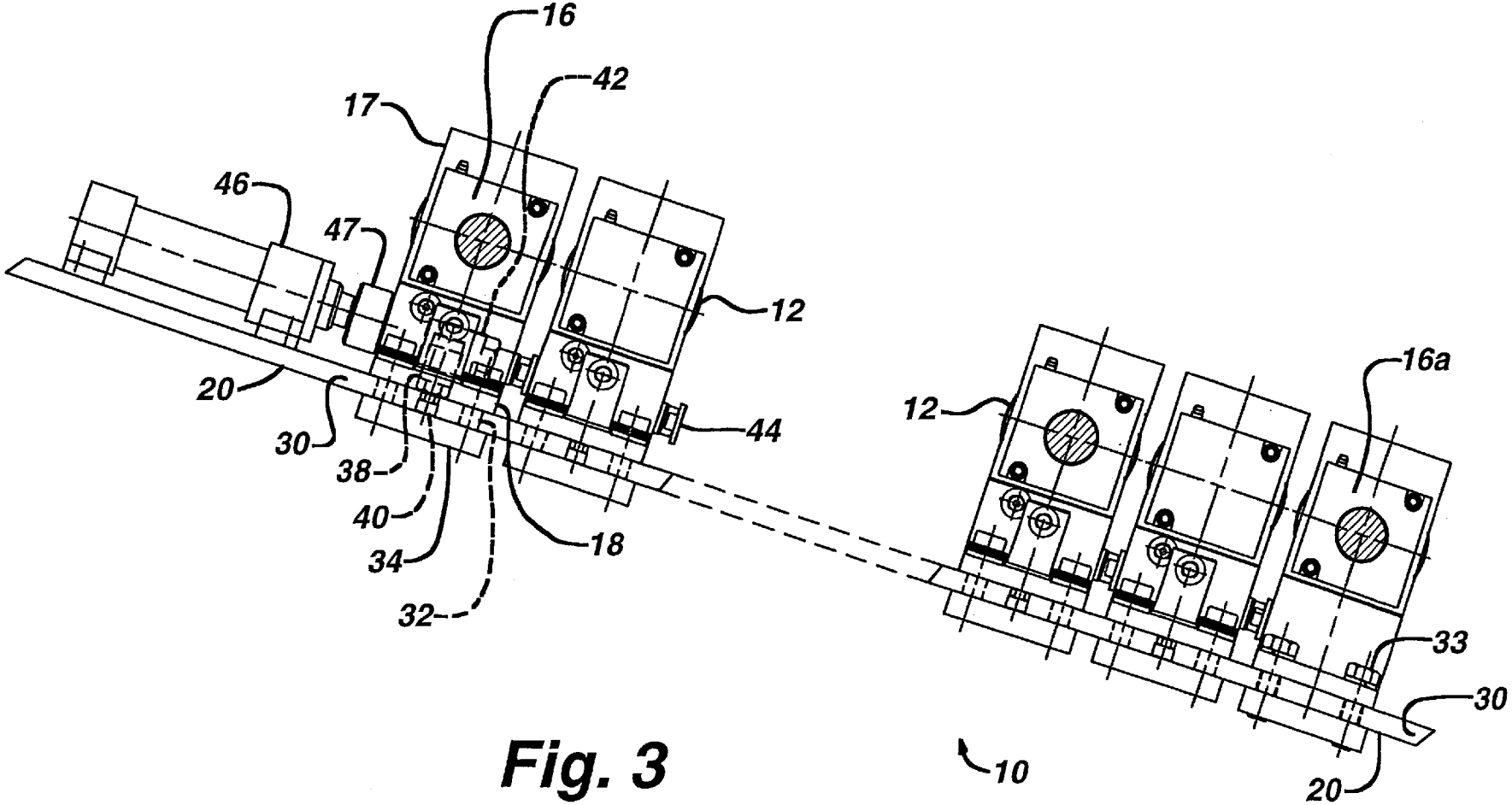
FIGS. 3, 3*a* and 3*b* are broken side views of an arrangement of rolls provided with a first, second and third embodiment of a gapping system according to the invention respectively.

Referring to FIGS. 1, 2 and 3, there are provided a first embodiment 10 of a roller screen gapping system according to the present invention and composed of a plurality of rolls 12, approximately ranging from 15 to 120 or any number deemed necessary for the particular screening process. The rolls 12 are mounted in spaced parallel relationship. Each end of each roll 12 has a shaft 14 rotatably mounted within a pillow block 16, or bearing blocks, having a top section 17 supported by a base section 18 slidably supported by a bed plate 20 of a machine frame 22. Each shaft 14 is preferably driven in rotation by a hydraulic motor 24 having an anti-rotation arm 26 in engagement with a rail 28 secured to the bed frame 22. The hydraulic motor 24 can be replaced if desired by an electric gear motor 24*a*, or a chain drive (not shown) common for any number of rolls. On each end of the rolls 12 a slot 30 is made in bed plate 20 transverse to the roll axes. Shoulder bolts 32 slidably extend through slot 30 and holes made in base section 18 and are screwed within a lock plate 34, biasing members, preferably belleville washers 36, are interposed between the base section 18 and the heads of the shoulder bolts 32. Therefore, the belleville washers 36 normally bias the lock plate 34 in engagement with the underside of the bed plate 20 to lock the pillow block 16 in a predetermined position transversely of the roll 12 and bed plate 20.

Figure 4:
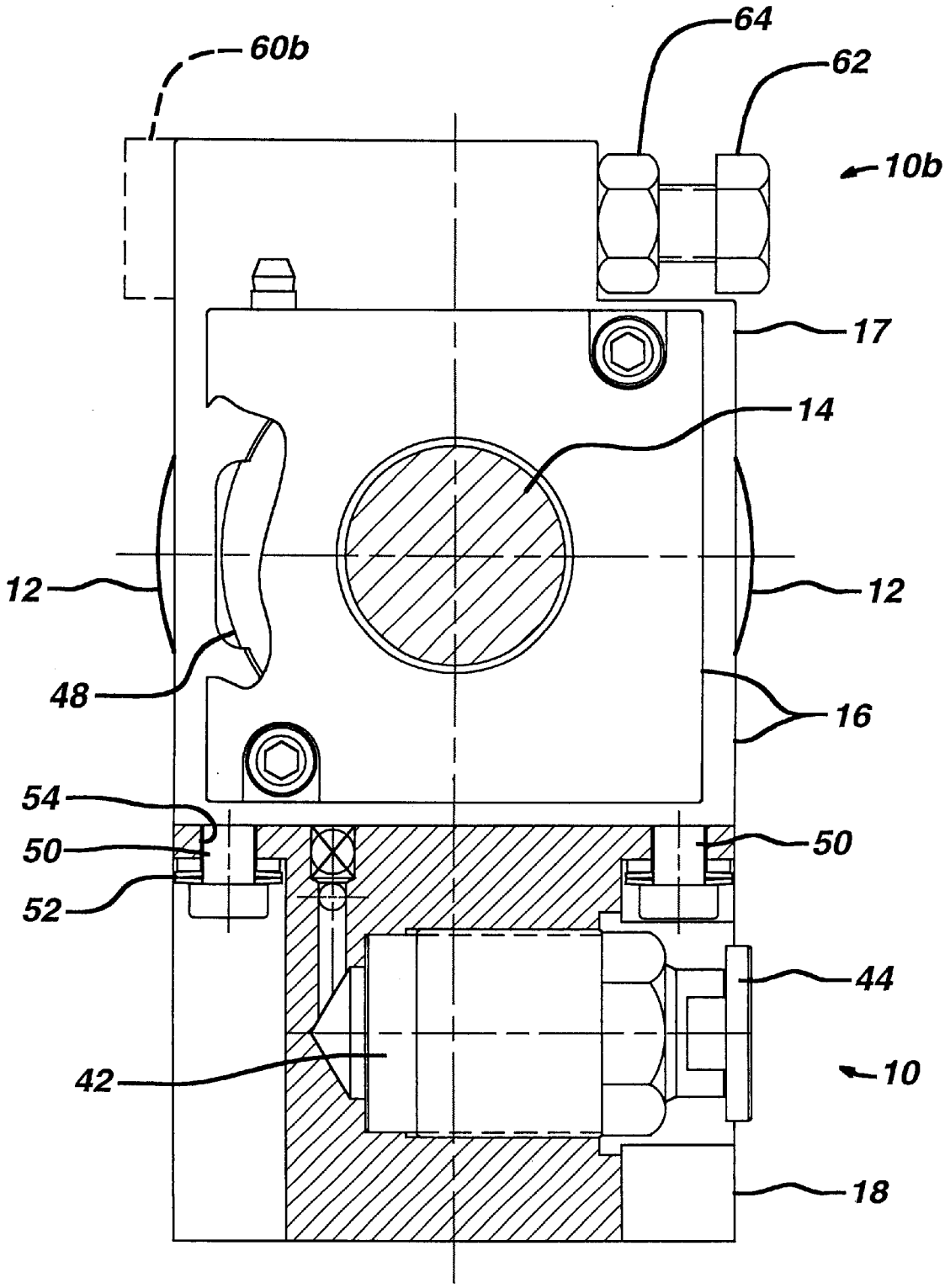
FIG. 4 is a side view, partially in section, taken along line 4—4 of FIG. 2 of one roll arrangement, and also showing a mounting plate arrangement with thermal stress relief feature.
Figure 5:
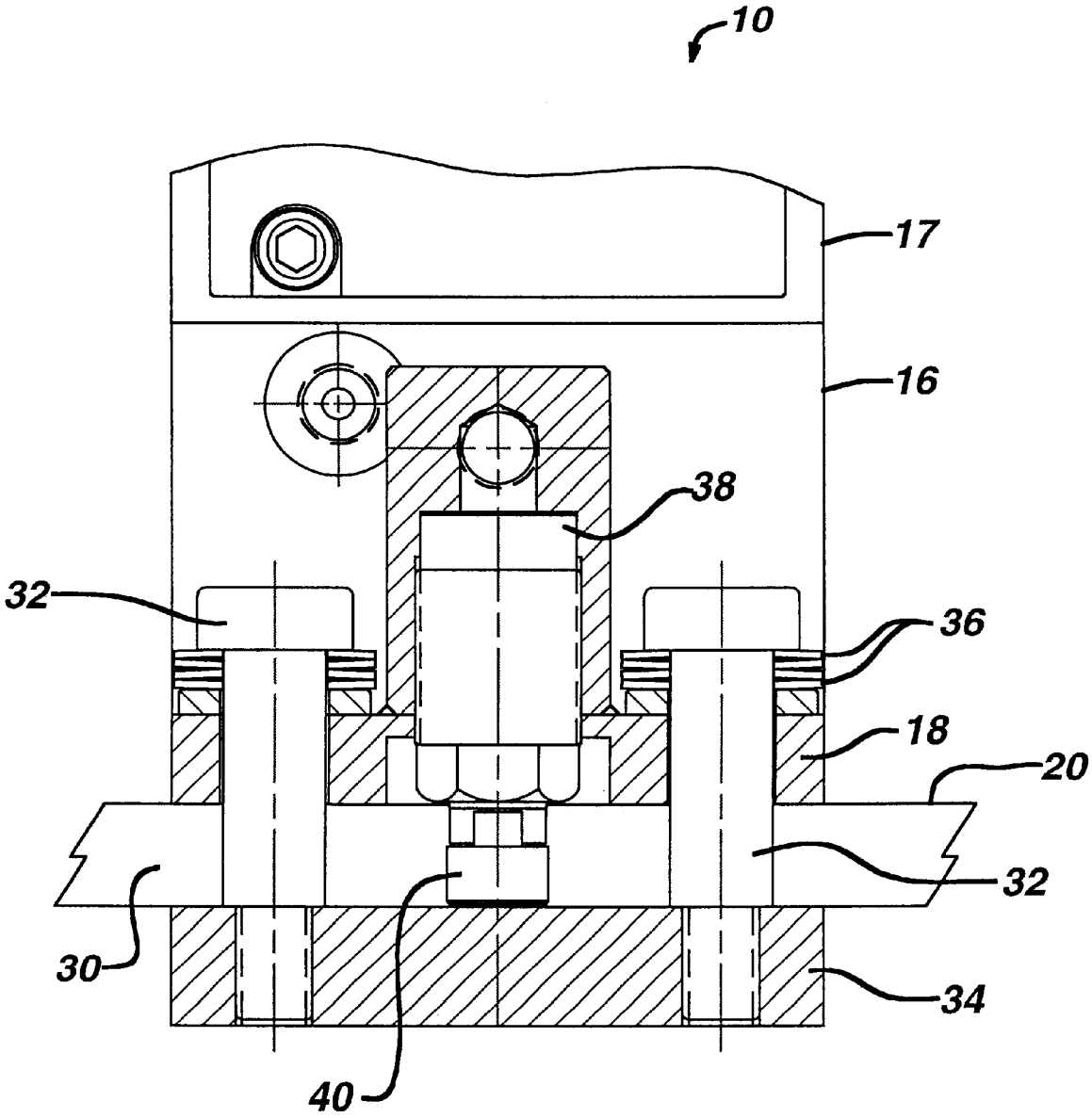
FIG. 5 is a vertical sectional view taken along line 5—5 of FIG. 2.
Figure 6:
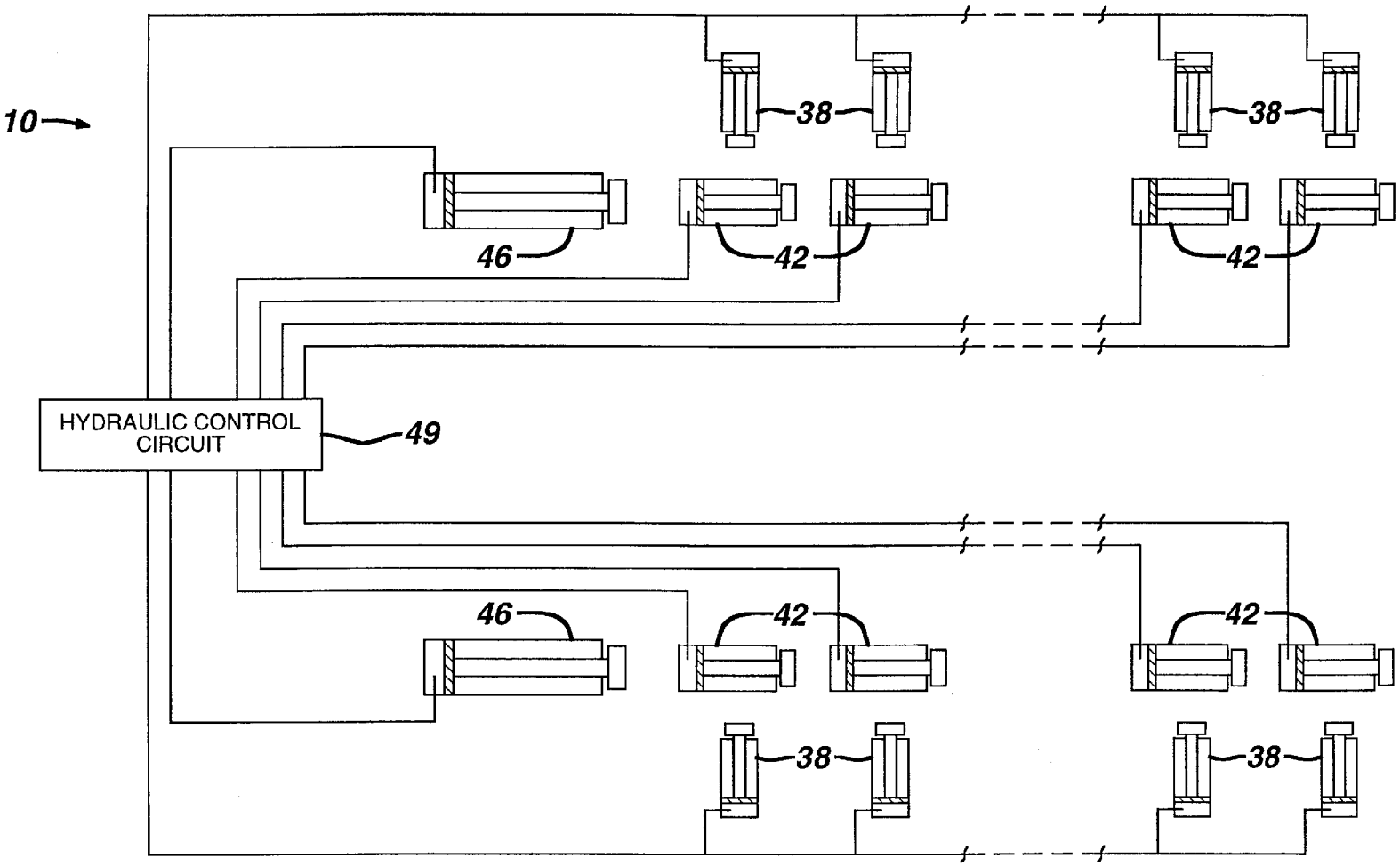
FIGS. 6 and 7 are schematic diagrams showing the hydraulic connections between the different types of cylinders for a fully and semi automated gapping control system respectively.

In accordance with the invention, there is provided at each end of each roll 12, an unclamping cylinder 38, substantially perpendicular to the bed plate 20, mounted in the pillow block base 18 and including a contact bolt 40 which upon activation of the cylinder 38 pushes down on the lock plate 34 to unclamp the base section 18 of the pillow block 16 and allow its sliding movement along the bed plate 20 (see FIG. 5). Each base section 18 of pillow block 16 also carries a gapping cylinder 42 (see FIG. 4), substantially parallel to the bed plate 20, which is mounted at each end of each roll 12 and having a contact bolt 44 adapted to contact the side of the adjacent pillow block 16. As shown in FIG. 3, the arrangement of the rolls 12 and their pillow blocks 16 are downwardly inclined towards the discharge end of the roller screen 10. The lowermost roll arrangement, which is the first of a series of rolls 12, has a pillow block 16*a* which is permanently secured to the bed plate 20 via bolts 33 and is therefore not provided with an unclamping cylinder 38 and a gapping cylinder 42. A common push cylinder 46 is fixed to the bed plate 20 and its contact bolt 47 is arranged to contact the uppermost pillow block 16 of the series at each end of the rolls 12. The line of action of the common cylinder 46 is substantially parallel, preferably co-axial with that of the gapping cylinders 42. As shown in FIG. 6, the various cylinders 38, 42 and 46 are preferably hydraulic cylinders and controlled by a hydraulic circuit 49 including various on and off solenoid valves (not shown). Obviously, other types of linear actuators could be used. One preferred and fully automated method of adjusting the gap between the various rolls 12 so as to have a uniform gap for the entire roller screen 10 is as follows.

While the unclamping cylinders 38 are actuated so as to unclamp all the pillow blocks 16 at each end thereof, the common push cylinders 46 are actuated to push all the pillow blocks 16 towards the first one of the series as indicated at 16*a* which is permanently secured in place. During this pushing movement the gapping cylinders 42 of one roll 12 (roll to be displaced) are allowed to retract. This pushing movement is accomplished to obtain a zero gap between two adjacent rolls 12. The gapping cylinders 42 of the roll 12 to be displaced are then fed with a precise quantity of hydraulic fluid to push this roll and its pillow blocks away from the next one a precise amount to obtain the required gap while the common push cylinders 46 are de-activated and allowed to partially retract. The same procedure is repeated for any roll gap to be adjusted. The unclamping cylinders 38 are then de-activated to allow clamping of all the pillow blocks 16 to the bed plates 20 by the belleville washers 36. Obviously, a roll gap between any pair of rolls 12 can be adjusted without having to adjust the gaps between the remaining rolls of the series since all gapping cylinders 42 of the different rolls 12 are independently actuated from each others, as represented by the different connection lines in FIG. 6.

Obviously, the control valves can be disposed away from the roller screen 10 itself and a circuit 49 provided with proper gauges calibrated to ensure a pre-determined gap between the various rolls 12. The cylinders 38, 42 and 46 at each end of the rolls 12 are arranged in parallel. In order to ensure that the gap between two adjacent rolls 12 is equally adjusted at each end of the rolls, the parallel circuits interconnecting the gapping cylinders 42 can be achieved using one pump having multiple outlets, one outlet per cylinder feeding circuit on each side of the roll 12 or one pump having a single outlet with a reversing valve which automatically reverses the cylinder feeding circuit on each side of the roll 12, or two pumps with synchronized drives, one for each side of the roll 12.

FIG. 4 also shows another feature of the present invention namely to see that the top section 17 of the pillow block 16 in which is mounted the shaft 14 of the roll 12 with the interposition of a bearing arrangement 48 is slidably mounted on the base section 18 and frictionally retained thereon by a shoulder bolt 50 with the interposition of a biasing device, preferably a belleville washer 52. It is seen that the shoulder bolt 50 is allowed to shift laterally in the axial direction of the roll 12 and shaft 14 within a cavity 54 made in the base section 18. This arrangement allows the top section 17 of the pillow block 16 to re-align itself with the roll axes to relieve any stress which might have developed within the bearing 48 due to the roll 12 and the shaft 14 expansions or contractions caused by temperature changes.

Figure 3A:
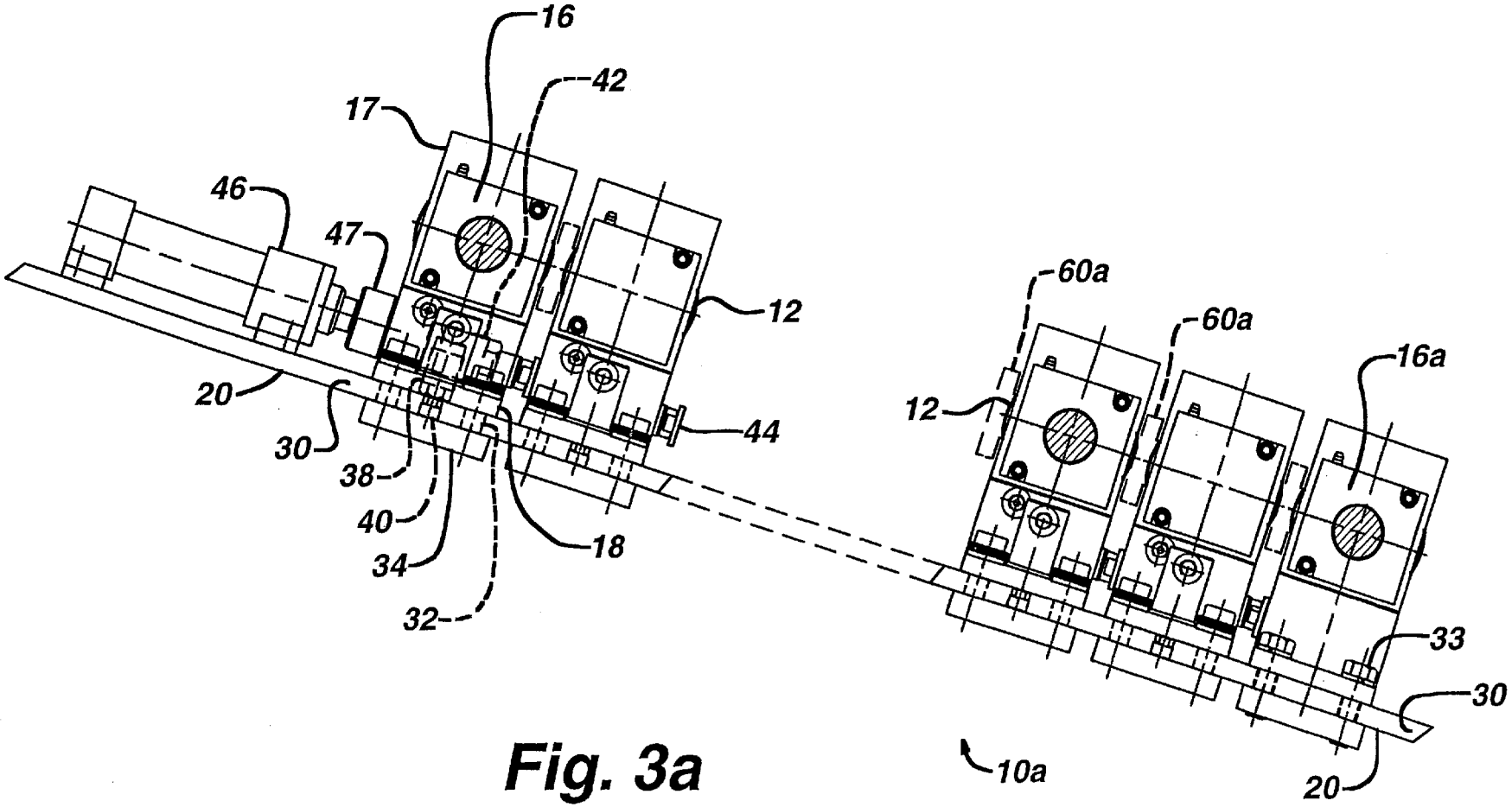
Figure 7:
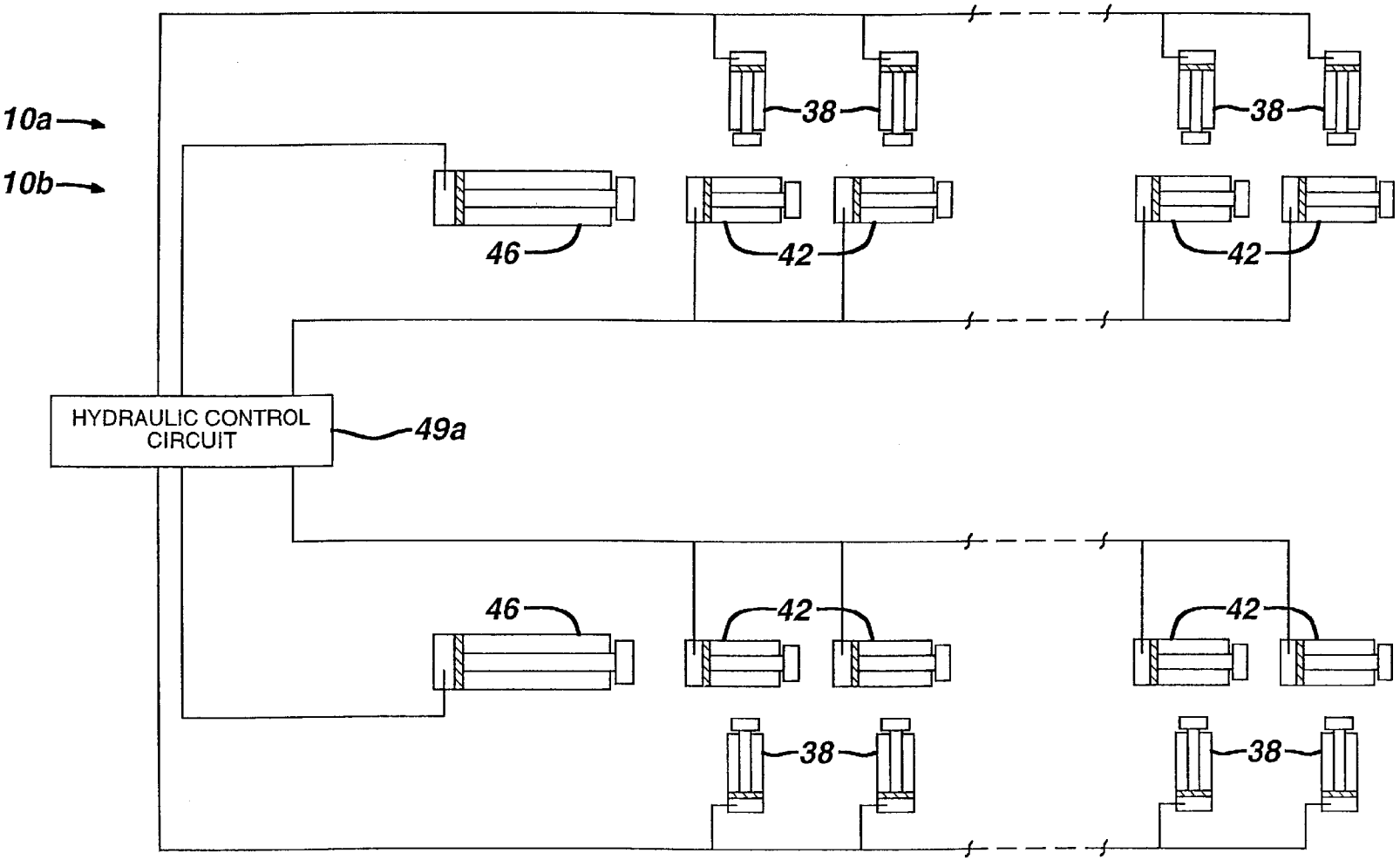

According to FIG. 3*a*, there is shown a second embodiment 10*a* of a gapping system in which the actual size of the gap between rolls 12 is achieved using a set of spacer members, preferably roll spacers 60*a*, each of specific thickness corresponding to the required gap between respective adjacent rolls 12. In this second embodiment 10*a*, the gapping cylinders 42 are used only to separate adjacent rolls 12 to maximum gapping. Accordingly, as described below and shown in FIG. 7, the hydraulic control circuit 49*a* is much simpler than the first embodiment 10 since all gapping cylinders 42 are simultaneously activated, being all connected in parallel to a same hydraulic line. The various cylinders 38, 42, 46 are preferably single acting and spring returned cylinders.

While the unclamping cylinders 38 are actuated so as to unclamp all the pillow blocks 16 at each end thereof, the gapping cylinders 42 are actuated to push all the pillow blocks 16 away from their respective previous adjacent one, thereby pushing onto the common cylinders 46 that are free to contract. This pushing movement is accomplished to maximize all the gaps between adjacent rolls 12, larger than any operating specified gap. Then, the roll spacers 60*a* are placed between adjacent rolls 12, either manually or automatically. The common cylinders 46 are then actuated to push all the pillow blocks 16 towards the first one 16*a* of the series while the gapping cylinders 42 are de-activated and free to contract. This second pushing movement is accomplished to ensure that each roll 12 touches its corresponding roll spacer 60*a* against the adjacent roll 12, thereby setting the uniform specified gap between all adjacent rolls 12. Preferably, just before and after the placing of the roll spacers 60*a*, the unclamping cylinders are de-activated and re-actuated back respectively, in order to prevent any sliding of the rolls 12 on the bed plates 20 during this spacer placement.

The unclamping cylinders 38 and the common cylinders 46 are then de-activated to allow clamping of all the pillow block 16 to the bed plates 20 and removing (either manually or automatically) of the roll spacers 60*a* respectively. Since the roll spacers 60*a* are located in between adjacent rolls 12, there is no need to compensate for any roll wear using this second embodiment 10*a*. Obviously, the common cylinders 46 have a piston adapted to cover the full stroke between all zero gap and all maximum gap conditions.

Figure 3B:
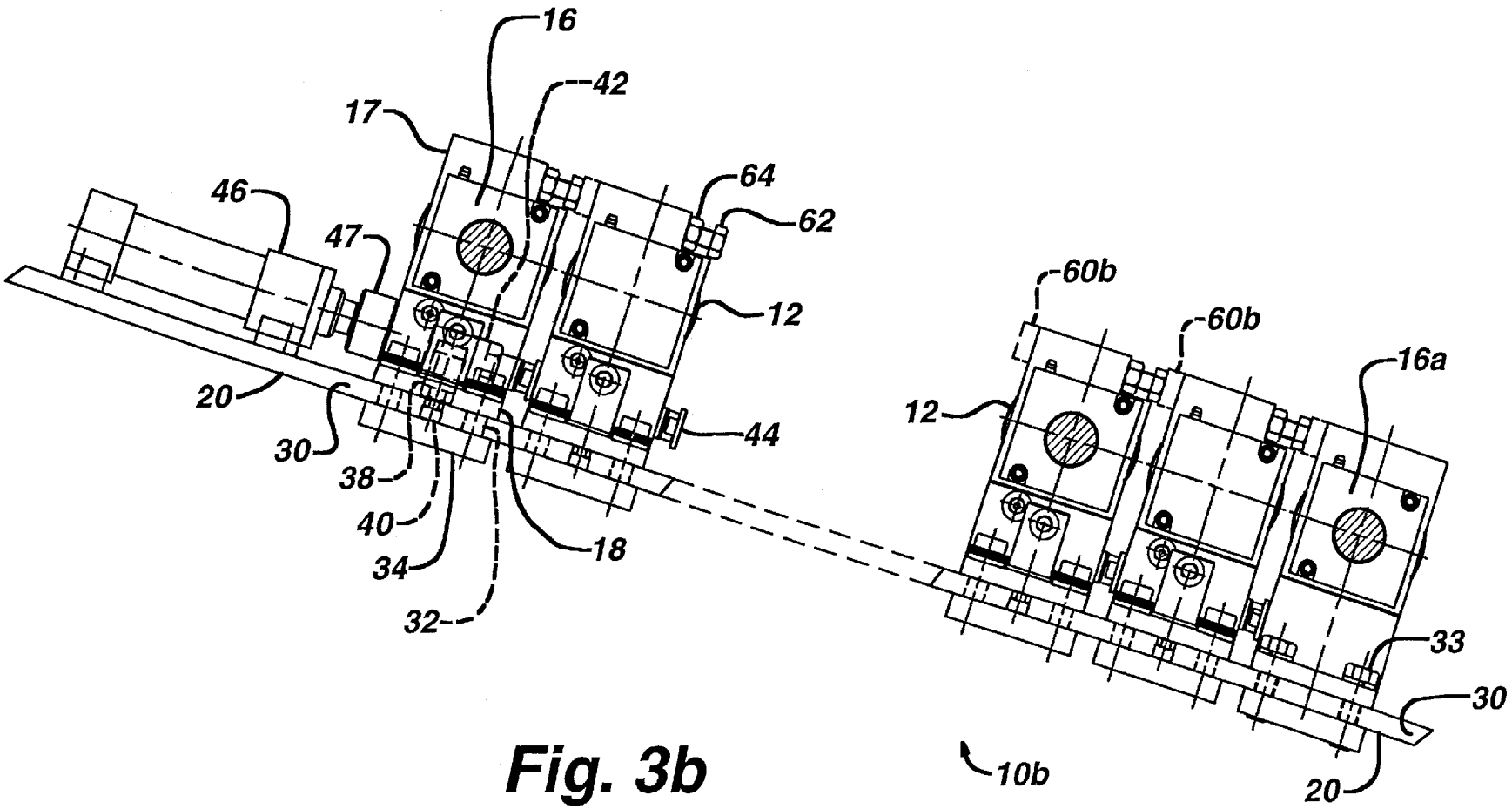

According to FIG. 3*b*, there is shown a third embodiment 10*b* of a gapping system in which the actual size of the gapping between rolls 12 is achieved using a set of pillow block spacers 60*b*, each of specific thickness corresponding to the required gap between adjacent rolls 12. In this third embodiment 10*b*, the same sequence of operation needs to be performed as explained above for the second embodiment 10*a*, with the exceptions that the spacers 60*b* are placed, either manually or automatically, preferably between top sections 17 of adjacent pillow blocks 16 and do not need to be removed at the end since they do not obstruct any roll operation.

Obviously, before performing the above sequence of operation, it is required, at least for the first time and subsequently as needed for compensation of roll wear to proceed with a zero gap setting, since the gap between adjacent pillow blocks 16 does not necessarily correspond to the respective gap between the adjacent respective rolls 12.

To perform the zero gap setting, each moving pillow block 16 further includes an adjustment member, preferably an adjustment screw 62, adapted to abut the side of the top section 17 of the adjacent pillow block 16.

Accordingly, while the unclamping cylinders 38 are actuated so as to unclamp all the pillow blocks 16 at each end thereof, the gapping cylinders 42 are actuated to push all the pillow blocks 16 away from their respective previous adjacent one, thereby pushing onto the common cylinders 46 that are free to contract. This pushing movement is accomplished to maximize all the gaps between adjacent rolls 12. Then, the spacers 60*b* are removed (either manually or automatically), if already in place, and the adjustment screws 62 are slightly screwed in to ensure that possibly worn adjacent rolls 12 will touch each other. The common cylinders 46 are then actuated to push all the pillow blocks 16 towards the first one 16*a* of the series while the gapping cylinders 42 are de-activated and free to contract. This second pushing movement is accomplished to ensure that each roll 12 touches its adjacent ones. The adjustment screws 62 are then unscrewed out until they touch their respective adjacent pillow block 16, and are preferably locked in place using a corresponding adjustment lock, preferably a nut 64, thereby setting the zero gap condition. Finally, the unclamping cylinders 38 are de-activated to allow clamping of all the pillow blocks 16 to the bed plates 20. Preferably, just before and after the screwing in of the adjustment screws 62, the unclamping cylinders are de-activated and re-actuated back respectively, in order to prevent any sliding of the rolls 12 on the bed plates 20 during this screwing operation.

Since all the block spacers 60*b* remain in place, this third embodiment 10*b* also allows for adjusting the gap between any number of rolls 12 at a time, as it is for the first embodiment 10.

Although embodiments have been described herein with some particularity and details, many modifications and variations of the preferred embodiments are possible without deviating from the scope of the present invention.

I claim:

1. A roller screen gapping system for a roller screen including a series of spaced parallel rolls mounted on pillow blocks at each end thereof, said pillow blocks slidable along respective bed plates transversely of the roll axes to adjust the gap between adjacent rolls, said system comprising biasing members to clamp said pillow blocks on said bed plates, unclamping cylinders carried by each pillow block and exerting an unclamping action on said bed plate to unclamp said pillow blocks for lateral sliding, gapping cylinders carried by each pillow block adapted to contact an adjacent pillow block to adjust the gap between adjacent rolls and a common push cylinder mounted on each of said bed plates and adapted to push all the pillow blocks against a fixed pillow block.

2. A system as defined in claim 1, wherein said cylinders are hydraulic cylinders connected to a hydraulic control circuit, said biasing members being spring biased bolts.

3. A system as defined in claim 1, wherein said gapping cylinders are adapted to maximize the gap between adjacent of said rolls, said system further comprising a plurality of spacer members each of a specific thickness adapted to set the gap between said adjacent rolls.

4. A system as defined in claim 3, wherein said cylinders are hydraulic cylinders connected to a hydraulic control circuit, said biasing members being spring biased bolts.

5. A system as defined in claim 3, wherein each of said pillow blocks further carries an adjustment member adapted to be displaced to and from said respective pillow block to adjust a relative zero gap between adjacent of said pillow blocks corresponding to a zero gap between respective of said rolls.

6. A system as defined in claim 5, wherein said cylinders are hydraulic cylinders connected to a hydraulic control circuit, said biasing members being spring biased bolts and said adjustment member being adjustment screws.

7. A system as defined in claim 6, wherein each of said adjustment members further include an adjustment lock to releasably lock said respective adjustment screw in position.

8. A system as defined in claim 1, wherein each one of said pillow blocks supporting an end of a shaft of a respective one of said rolls and including a top section adapted to rotatably support the end of said shaft and a base section rigidly mounted onto said bed plate, said top section being slidably mounted onto said base section and frictionally retained thereon by a shoulder bolt with interposition of a biasing device, said top section being allowed to slightly slide along the axial direction of said shaft, thereby accounting for small axial displacement of said roll and said shaft caused by expansion and contraction of the latter under temperature changes.

9. A system as defined in claim 8, wherein said biasing device being a belleville washer.

10. A method for adjusting a gap between respective adjacent rolls of a roller screen apparatus using a roller screen gapping system as defined in claim 1, said method comprising the steps of:

a) actuating said unclamping cylinders;

b) actuating said common push cylinders to push all of said pillow blocks against said fixed pillow block to set a zero gap condition of at least one of said rolls to be displaced, while said gapping cylinders of said at least one roll to be displaced being allowed to retract;

c) actuating said gapping cylinders of said at least one roll by a precise amount to obtain a required respective gap between the latter and the respective next of said rolls, while said common cylinders being allowed to partially retract; and d) de-actuating said unclamping cylinders to allow for the clamping of said pillow blocks to respective of said bed plates.

11. A method as defined in claim 10, wherein said steps b) and c) being repeated before step d) for each of said respective gap to be adjusted.

12. A method for adjusting a gap between respective adjacent rolls of a roller screen apparatus using a roller screen gapping system as defined in claim 3, said method comprising the steps of:

a) actuating said unclamping cylinders;

b) actuating said gapping cylinders to push all of said pillow blocks away from adjacent of said pillow blocks to maximize said gap between adjacent of said rolls, while said common push cylinders being allowed to retract;

c) placing said spacer members between respective said adjacent rolls;

d) actuating said common push cylinders to displace all of said pillow blocks toward said fixed pillow block to ensure each of said spacer members being touched by two adjacent of said rolls, while said gapping cylinders being allowed to retract;

e) de-actuating said unclamping cylinders to allow for the clamping of said pillow blocks to respective of said bed plates; and f) removing all of said spacer members.

13. A method as defined in claim 12, further comprising, after steps b) and c) the step of, respectively:

b') de-actuating said unclamping cylinders to allow for the clamping of said pillow blocks to respective of said bed plates; and c') actuating said unclamping cylinders.

14. A method for adjusting a gap between respective adjacent rolls of a roller screen apparatus using a roller screen gapping system as defined in claim 5, said method comprising the steps of:

a) actuating said unclamping cylinders;

b) actuating said gapping cylinders to push all of said pillow blocks away from adjacent of said pillow blocks to maximize said gap between adjacent of said rolls, while said common push cylinders being allowed to retract;

c) placing said spacer members between respective said adjacent pillow blocks next to said respective adjustment member;

d) actuating said common push cylinders to displace all of said pillow blocks toward said fixed pillow block to ensure each of said spacer members being touched by two adjacent of said pillow blocks, while said gapping cylinders being allowed to retract; and e) de-actuating said unclamping cylinders to allow for the clamping of said pillow blocks to respective of said bed plates.

15. A method as defined in claim 14, said method further comprising, before the step a) the steps of:

i) actuating said unclamping cylinders;

ii) actuating said gapping cylinders to push all of said pillow blocks away from adjacent of said pillow blocks to maximize said gap between adjacent of said rolls, while said common push cylinders being allowed to retract;

iii) removing said spacer members if they are in place, and slightly displacing said adjustment members towards respective of said pillow blocks;

iv) actuating said common push cylinders to displace all of said pillow blocks toward said fixed pillow block to ensure each of said rolls touching its adjacent ones and set a zero gap condition between all of said adjacent rolls, while said gapping cylinders being allowed to retract;

v) de-actuating said unclamping cylinders to allow for the clamping of said pillow blocks to respective of said bed plates; and vi) displacing said adjustment members away from respective of said pillow blocks until touching the adjacent of said pillow blocks.

16. A method as defined in claim 15, further comprising, after steps ii), iii), b) and c) the step of, respectively:

ii') de-actuating said unclamping cylinders to allow for the clamping of said pillow blocks to respective of said bed plates;

iii') actuating said unclamping cylinders;

b') de-actuating said unclamping cylinders to allow for the clamping of said pillow blocks to respective of said bed plates; and c') actuating said unclamping cylinders.

* * * * *